US005577721A

United States Patent [19]

Hardee et al.

[11] Patent Number: 5,577,721

[45] Date of Patent: Nov. 26, 1996

[54] PORTABLE BATTING CAGE WITH EXTENDED HINGED WINGS

[75] Inventors: David B. Hardee, Fernandina Beach; William H. Burbank, III, Oneal, both of Fla.

[73] Assignee: Standard Marine Supply Corp., Fernandina Beach, Fla.

[21] Appl. No.: 434,414

[22] Filed: May 3, 1995

[51] Int. Cl.[6] ..... A63B 69/00

[52] U.S. Cl. ..... 273/26 A

[58] Field of Search ..... 273/26 A, 410, 273/411, 29 B, 29 A

[56] References Cited

U.S. PATENT DOCUMENTS

| | | | |
|---|---|---|---|
| 849,941 | 4/1907 | Titus | 273/26 A |
| 1,591,753 | 7/1926 | Flaugh | 273/26 A |
| 2,827,295 | 3/1958 | Austin | 273/26 A |
| 2,988,360 | 6/1961 | Lambiotte | 273/26 A |
| 3,339,925 | 9/1967 | Nissen | 273/410 |
| 3,408,071 | 10/1968 | Lundy | 273/26 A |
| 3,593,997 | 7/1971 | Boehner | 273/26 A |
| 3,948,512 | 4/1976 | Worthington | 273/29 A |
| 4,192,503 | 3/1980 | Karas | 273/29 A |
| 4,415,154 | 11/1983 | Engelhardt | 273/26 A |
| 4,473,227 | 9/1984 | Klaus | 273/26 A |
| 4,932,657 | 6/1990 | Hailer | 273/26 A |
| 5,344,157 | 9/1994 | McCord | 273/29 B |
| 5,370,385 | 12/1994 | Joy | 273/29 A |

*Primary Examiner*—Theatrice Brown
*Attorney, Agent, or Firm*—Thomas C. Saitta

[57] ABSTRACT

A portable batting cage having a backstop, two extended wings, a top and wheels is disclosed, the wings being pivotally mounted onto the backstop to allow adjustment to different relative angles. An extended tongue is provided to counterbalance the extended length of the wings, the wings being longer than the backstop. The top is non-rigid to allow for multiple positioning of the wings.

9 Claims, 2 Drawing Sheets

PORTABLE BATTING CAGE WITH EXTENDED HINGED WINGS

BACKGROUND OF THE INVENTION

The invention relates generally to the field of portable batting cages, i.e., batting cages having wheels and constructed so as to be movable. More particularly, the invention relates to such batting cages having a backstop, a top and two lateral wings where the wings are hingedly attached to the backstop so as to be laterally adjustable to various angles relative to the backstop. Even more particularly, the invention relates to such batting cages where the wings are of greater length than the backstop, requiring placement of wheels on the ends of the lateral wings and a wheeled extension or tongue attached to the backstop for stability.

Batting cages are used in practicing such sports as baseball or softball where a batter must strike a pitched ball. The batting cages are designed to restrict the flight of mis-hit or foul balls or to stop missed or bad pitches, and typically take the form of a planar backstop portion comprising a frame with a mesh or net positioned behind the batter and perpendicular to the line between the pitcher and the plate or target area, with lateral wings or sides also comprising a frame with mesh or net extending a short distance forward from each end of the backstop portion to enclose the batter laterally. The wings of most portable cages are fixed in position relative to the backstop, usually at a 90 degree angle. The batting cages are preferably provided with tops, usually either framed or unframed mesh or net, extending from the backstop and wings. Thus balls travelling in the rearward or sideward direction are trapped by the cage, allowing for easy retrieval and protecting others in the vicinity from being struck by errant balls. Since it is desirable to be able to locate and remove the cages easily, many are provided with wheels and are constructed of steel or aluminum tubing to allow them to be moved by a small tractor or several people. These wheels are generally relatively large and are usually positioned one on each lateral wing and one in the middle of the backstop portion on cages where the wings are fixed, or have two wheels attached to the backstop and a single wheel set forward on a short tongue for batting cages with hinged wings, with each wheel being mounted on a fixed axle and all wheels being aligned parallel with each other.

Known portable, wheeled batting cages having lateral, hinged wings constructed using lightweight tubing for the frame members are limited as to the length of the lateral wings because of inherent balancing problems, such that the known constructions all use hinged wings shorter than the width of the backstop portion. The shorter lateral wings capture fewer mis-hit balls because the area of unrestricted flight is determined by how far in front of the batter the wings extend, with shorter wings resulting in greater open areas for unrestricted flight. Extending the length of the lateral wings to decrease the open area of unrestricted flight and to increase the amount of protected area creates an unbalanced structure, interfering with the mobility of the device and requiring some sort of support at the free ends of the hinged wings. Fixed alignment wheels cannot be used on the hinged wings, since they will not remain aligned during transport.

It is an object of this invention to provide a portable, wheeled batting cage having a horizontal backstop, hinged lateral wings and a top, where the lateral wings are longer than the backstop to increase the amount of protection and decrease the area of unrestricted flight, and which is balanced to allow easy transport of the entire batting cage. It is a further object to provide such a batting cage where the extended lateral wings are effectively counter-balanced by an extended tongue structure forward of the backstop, and a still further object is to provide such a batting cage where the wheels are small and five in number, being pivotally attached to the batting cage preferably at the free end of each wing, at the attached end of each wing, and at the end of the extended tongue.

SUMMARY OF THE INVENTION

The invention is a portable batting cage generally comprising a backstop member, a first lateral wing, a second lateral wing and a top, where the lateral wings are pivotally connected by hinges or the like to opposite ends of the backstop, and where wheels are provided to allow the device to be moved. The lateral wings and the backstop are comprised of rigid, light-weight frame members to which is attached a mesh or netting material. The top is comprised of a mesh or netting material with no frame member. The length of each of the lateral wings is greater than the length of the backstop, and the top is of sufficient width to allow the lateral wings to be swung outward from a position perpendicular to said backstop to adjust the angle and direction of unrestricted flight of the ball, i.e., the amount of open area in the front of the batting cage and the direction of that flight relative to the backstop. Extended lateral wings are desirable to increase the area protected by the batting cage by reducing the angle of unrestricted flight. In order to balance the extended wings and to allow for transportation of the device, wheels are mounted onto the lateral wings themselves, with one each being preferably attached adjacent the free end of each lateral wing. The wheels must be pivotally mounted to allow the device to be transported without requiring alignment of the wings in a particular position relative to each other and to the backstop, and to allow their use as supports for each wing as the angle is adjusted. To further balance the device, an extended tongue is provided to the rear of the backstop, with a wheel also mounted on this tongue. To further increase the stability and transportability of the device, additional wheels are pivotally mounted onto the lateral wings at the attached ends as well. Providing five such wheels allows for the use of small diameter wheels.

The top netting is attached to the frame members of the backstop and the lateral wings by netting attachment means which are preferably detachable, such as a hook and loop type fastener. Likewise, the netting is also preferably attached to the lateral wings and the backstop by these same type fasteners. As each of the lateral wings will usually be positioned during use at an interior angle of between 90 and 135 degrees relative to the backstop, the top is sized to completely cover the area between the two lateral wings even when they are fully opened. The top netting can be allowed to drop when the wings are less than fully opened, or it can be adjusted by top suspension means or top tightening means, such as a rope or unattached bar threaded through the netting material, to take up any slack. Alternatively, the netting attachment means for the top can be detached from the frame members and either attached to points lower on each lateral wing or the top netting material bunched up and reattached to take up the slack in the top netting.

A batting cage constructed as above described can have a backstop 10 feet long and 9 feet high with a pair of wings 14 feet long and 9 feet high. The length of the wings is much greater than normally found in portable batting cages having hinged wings. This design allows two such batting cages to be connected laterally while facing in the same general direction, the wing of one cage being positioned flush with the wing of another batting cage. The extended length of the lateral wing on the common side, plus the ability to control the unrestricted flight angle of each cage independently of the other by alignment of the backstop and the free wing, allow two players to take batting practice simultaneously without danger to each other or to other players in the field. Preferably, dual wing attachment means, such as mechanical fasteners or hook and loop type fasteners are provided on the vertical members of the lateral wing frames to provide for quick and easy connection or disconnection.

DETAILED DESCRIPTION OF THE INVENTION

Figure 1:
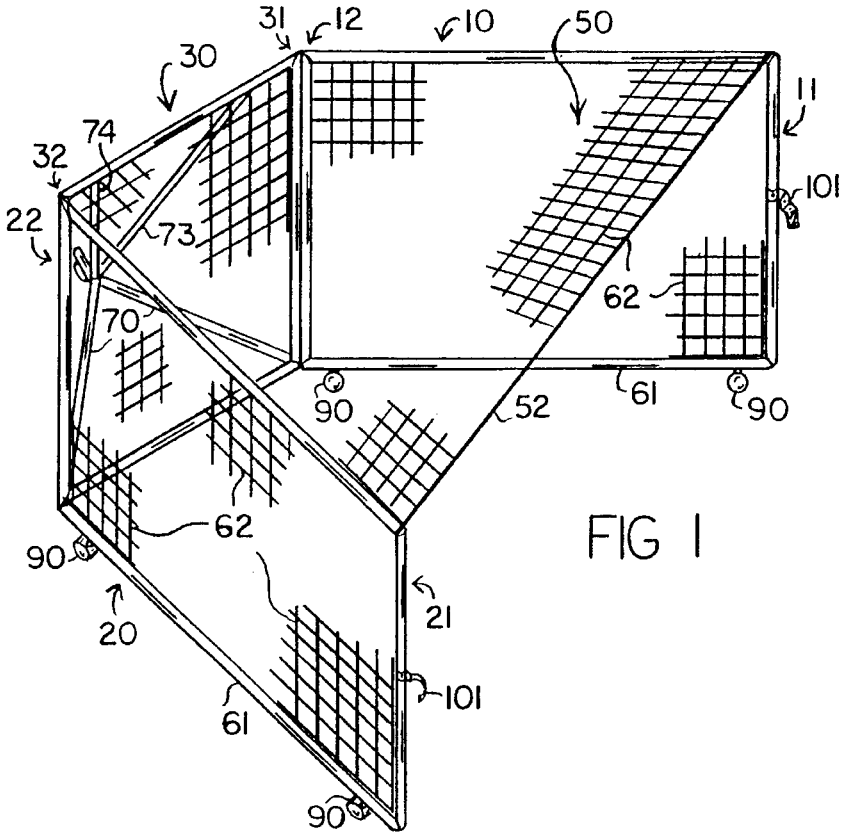
FIG. 1 is a perspective view of the invention.

With reference to the figures, the invention will now be described in detail, including the best mode and preferred embodiment. In general, the invention is a portable batting cage comprising the combination of a backstop member 30, a first lateral wing 10, a second lateral wing 20, a non-rigid top member 50 and wheels 90. The backstop 30 is generally rectangular and planar, and comprises a netting material 62 mounted onto a peripheral frame 61 by netting attachment means 63. The first lateral wing 10 and second lateral wing 20 are also generally rectangular and planar, and are each comprised of a netting material 62 mounted onto a peripheral frame 61 by netting attachment means 63. The top member 50 is comprised of a netting material 62 with no peripheral frame, the top member 50 being attached to the upper portion of the frames 61 of the backstop 30, first lateral wing 10 and second lateral wing 20 by netting attachment means 63. The netting material 62 is comprised of any suitable net or mesh type material with good strength and durability characteristics. The peripheral frames 61 forming the backstop 30, the first lateral wing 10 and the second lateral wing 20 are composed of any suitable strong but lightweight material, such as metal tubing or preferably PVC tubing. The netting attachment means 63 may comprise any suitable type of fastener known in the art capable of connecting the netting material 62 to the frames 61, such as rivets or threaded bolts for relatively permanent attachment or preferably hook and loop type fastening straps which allow for easy adjustment.

The first lateral wing 10 has a free end 11 and an attached end 12, the attached end 12 being pivotally or hingedly attached to the first end 31 of backstop 30, and the second lateral wing 20 has a free end 21 and an attached end 22, the attached end 22 being pivotally or hingedly attached to the second end 32 of backstop 30. Both the first lateral wing 10 and the second lateral wing 20 are connected to the backstop 30 such that each wing 10 and 20 extends from the same side of backstop 30 to form an enclosed area having three generally vertical walls and a generally horizontal top 50. The open side allows balls to be pitched to a batter positioned within the batting cage and allows balls hit by the batter to travel in any direction and to any distance not impeded by either the backstop 30, the wings 10 and 20 or the top 50. Each of the lateral wings 10 and 20 is pivotally attached to the backstop 30 by wing attachment means 33 comprising any suitable pivot or hinge mechanism which allows each wing 10 and 20 to be individually positioned at various angles relative to the backstop 30.

Figure 3:
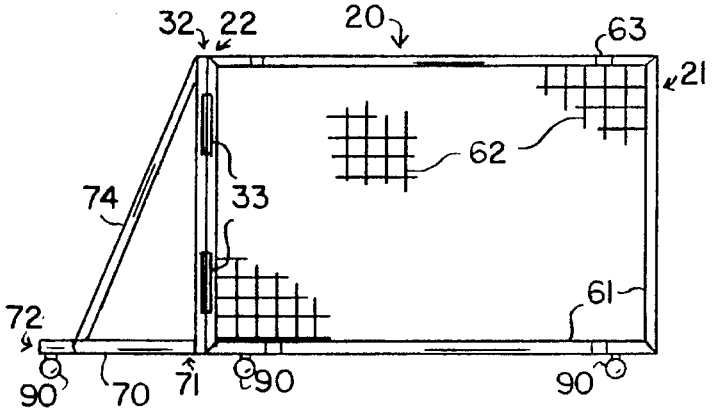
FIG. 3 is a side view of the invention.
Figure 4:
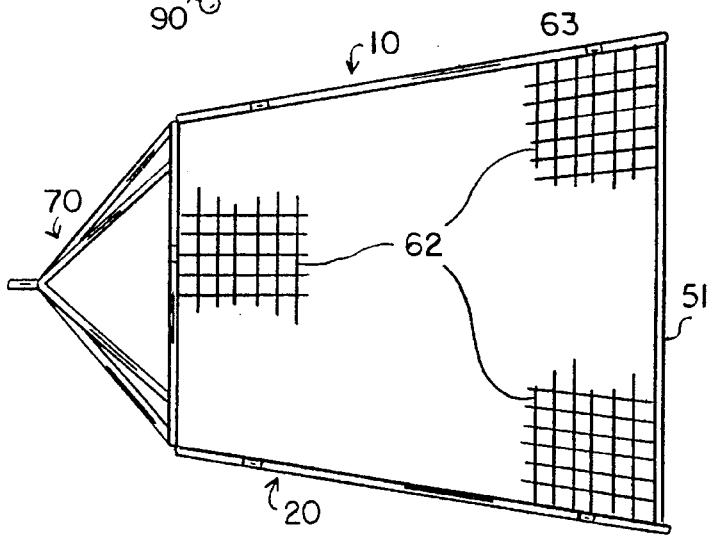
FIG. 4 is a top view of the invention.
Figure 2:
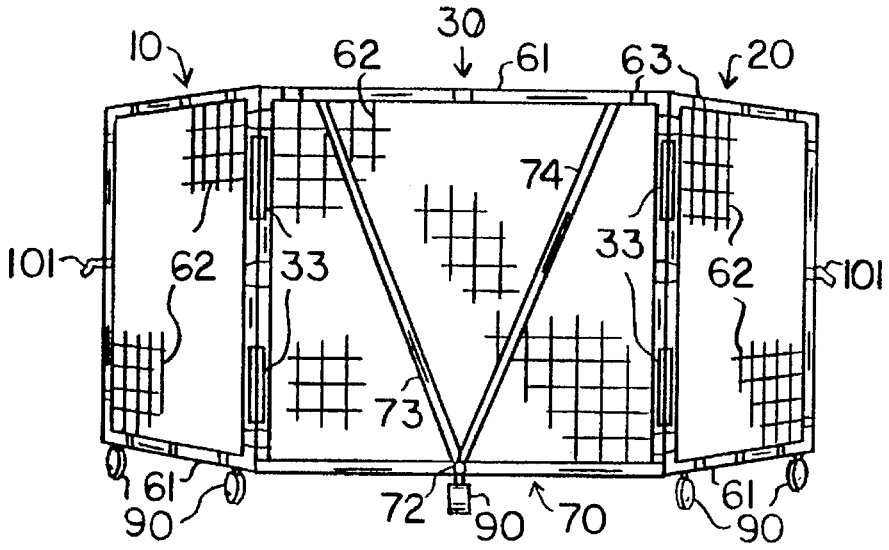
FIG. 2 is a rear view of the invention.

The first lateral wing 10 is longer than the backstop 30, and the second lateral wing is longer that the backstop 30. Preferably each wing 10 and 20 is the same length. Because of the extended length of each wing 10 and 20, the batting cage would have its center of gravity at some point in the interior of the enclosed area formed by the backstop 30, wing 10, wing 20 and top 50. In order to compensate for this, an extended tongue member 70 is connected to the backstop 30 on the side and in the direction opposite to the side and direction in which the wings 10 and 20 extend. The extended tongue 70 acts to counterbalance the other components when the cage is in use and, more importantly, when the cage is being moved. The extended tongue comprises a fixed end 71 connected to the backstop 30 and a free end 71, and is preferably configured as a double V-shaped member with tubular components, a first V-shaped connector member 73 connecting the free end 71 to the first end 31 of the backstop 30 and a second V-shaped connector member 74 connecting the free end 71 to the second end 32 of the backstop 30. The V-shape enables the extended tongue 70 to connect to both the upper and lower portions of the frame 61 of backstop 30 as shown in FIG. 3.

Wheels 90 allow the batting cage to be easily transported by pulling the extended tongue 70. One wheel 90 is mounted onto the free end 72 of the extended tongue 70, another wheel 90 is mounted onto the first lateral wing 10 and another wheel 90 is mounted onto the second lateral wing 20. Because the lateral wings 10 and 20 are pivotally attached to the backstop 30, it is preferred that the wheels 90 be pivotally mounted, such that each wheel 90 is free to turn to any position on its vertical axis relative to the component of the batting cage to which it is attached. By using wheels 90 with non-fixed alignments, it is not necessary to align the wings 10 and 20 relative to the backstop 30 prior to movement of the entire cage. Likewise, when adjusting the angle of the lateral wings 10 and 20 relative to the backstop 30, each wheel 90 will align itself in the direction of movement of the wing 10 or 20. Since the wheels 90 are the supports for the cage, being the only rigid structural components which contact the ground, the ability to pivot in any direction is especially useful when the wings 10 and 20 are being positioned for use or storage. To facilitate this, it is preferred that each wheel 90 mounted onto the lateral wings 10 and 20 be mounted near or adjacent the free ends 11 and 21. For added stability and ease of transport, it is preferred that additional wheels 90 be mounted onto each lateral wing 10 and 20, one wheel 90 being mounted adjacent or near the attached end 12 of first lateral wing 10 and another wheel 90 being mounted adjacent or near the attached end 22 of second lateral wing 20. The use of five wheels 90 creates a very stable configuration by providing for two ground supports/or each extended lateral wing 10 and 20 and by providing for five ground support points for the entire cage, and further enables the use of small diameter wheels 90 without sacrificing ease of transport. While it is preferred that two wheels 90 be attached to each lateral wing 10 and 20, it is foreseeable to mount a wheel 90 at the first end 31 and second end 32 of backstop 30 instead of adjacent the attached ends 12 and 22 of lateral wings 10 and 20.

Top member 50 of the batting cage must be non-rigid to accommodate the adjustability of the lateral wings 10 and 20. Top 50 comprises netting material 62 connected to the upper frames 61 of the backstop 30, the first lateral wing 10 and the second lateral wing 20 by netting attachment means 63, which can comprise any suitable type fastener but preferably a type which is readily detachable and reattachable, such as hook and loop fastener straps. To allow for extension of the lateral wings 10 and 20 to interior angles relative to the backstop 30 greater than 90 degrees, it is necessary that the top 50 be trapezoidal in configuration, with the side connecting the free ends of 11 and 21 of lateral wings 10 and 20 being longer than the side attached to the backstop 30. When the lateral wings 10 and 20 are not positioned at their maximum spread, there will be some amount of slack in the top 50 whereby the netting material 62 will not remain taut. This sagging will be most pronounced at the open end of the batting cage and will droop the most when the free ends 11 and 21 of lateral wings 10 and 20 are closer together. This will usually not interfere with the effectiveness of the cage, but can be accounted for if desired. To remove the slack, the top 50 can be disconnected from one or both lateral wings 10 or 20, the netting material 62 pulled tight to take up the slack and then reattached to the lateral wings 10 or 20 by refastening netting attachment means 63. Alternatively, top suspension means 51 or top tightening means 52 can be added. Top suspension means 51 may comprise a rigid member such as a rod or beam placed atop the lateral wings 10 and 20 which is threaded through the netting material 62 of top 50 or which has mechanical means, such as hooks or the like, to grasp portions of the netting material 62 to maintain it in a relatively horizontal position. Alternatively, top suspension means 51 may comprise an elastic cord or strap threaded through the netting material 62 of top 50 and connected between each lateral wing 10 and 20, the cord being expandable to allow the wings 10 and 20 to be positioned at any relative angle while the strap maintains its horizontal position. Another means to remove the slack from the top 50 is to utilize top tightening means 52, such as a rope or elastic strap with hooks which can be used to grasp middle portions of the netting material 62 to pull it toward one or both of the lateral wings 10 or 20.

The purpose of a batting cage is to create a limited area or arc of unimpeded or unrestricted flight of a batted ball while providing an enclosed structure to stop the flight of balls hit laterally, rearward or upward, and to stop any missed pitches, such that other players and bystanders are not endangered during practice. The backstop portion of a cage must be positioned a minimum distance behind the batter to allow for room to swing the bat. The area or arc of unrestricted flight for any batting cage is a function of the distance between the lateral wings and the length of the lateral wings. The longer the lateral wings, the greater the ability to narrow the area or arc of unrestricted flight, since the farther the wings extend in front of the batter, the lesser the arc of unrestricted flight. By structuring the batting cage as set forth in this disclosure, a transportable cage having long wings is possible. Since lateral wings 10 and 20 are longer than backstop 30, the area of unrestricted flight can be adjusted by positioning the backstop 30 farther from or closer to the batter, or by adjusting the angle of each lateral wing 10 or 20 relative to the backstop 30. The narrower the internal angle, such that the free ends 11 and 21 are closer together, the lesser the arc of unrestricted flight, which in turn protects a greater area of the field. To open up the area of unrestricted flight, the lateral wings 10 and 20 are spaced farther apart, i.e., the internal angle between each wing 10 or 20 and backstop 30 is increased. Depending on the particular situation, any interior angle between lateral wing 10 or 20 and backstop 30 of from 90 degrees to 135 degrees can be accommodated.

Figure 5:
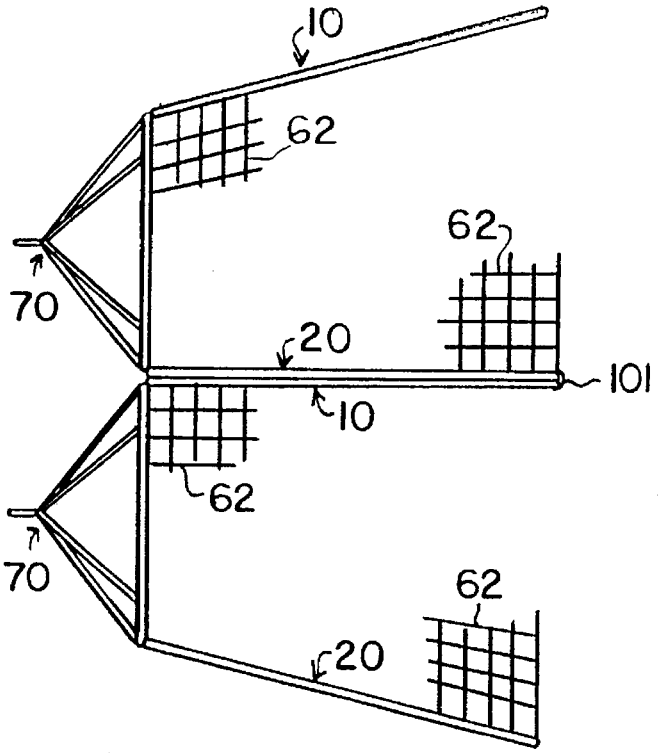
FIG. 5 is a top view of two cages adjoined to form a dual unit.

Since baseball teams contain a large number of individuals, it is desirable to allow more than one batter to take batting practice at the same time. Most teams, however, have only one field and cannot therefore set up two separate batting practice areas, since balls would be coming at the fielders from separate directions. By providing a cage with extended lateral wings 10 and 20 which pivot relative to the backstop 30, it is possible to arrange two such cages side by side with both batters facing the same direction whereby batted balls will travel to the fielders from a single area, as shown in FIG. 5. A first lateral wing 10 of one cage is positioned adjacent a second lateral wing 20 of a second cage, and the two wings 10 and 20 are preferably connected using dual wing attachment means 101, which can comprise either mechanical means such as a hook or bracket, or hook and loop type means. Since the wings 10 and 20 are positionable relative to the backstops 30, each backstop 30 can be set at a desired angle relative to the two joined wings 10 and 20, such that the two backstops can be kept parallel or set at an angle to the other. Likewise the unjoined wings 20 of the first cage and 10 of the second cage can be positioned at any angle relative to each backstop 30. Thus the arc or area of unrestricted flight of each cage can be independently controlled, both as to its direction relative to the batter and the width of the unrestricted flight area.

It is contemplated that substitutions and equivalents may become known or be obvious to those skilled in the art, and the true scope and definition of the invention therefore is to be as wet forth in the following claims, the above examples being by way of illustration only.

We claim:

1. A portable batting cage comprising a backstop having a first end and a second end, a first lateral wing having a free end and an attached end, said first lateral wing attached end being pivotally attached by wing attachment means to said first end of said backstop, a second lateral wing having a free end and an attached end, said second lateral wing attached end being pivotally attached by wing attachment means to said second end of said backstop, and a non-rigid top connected to said backstop, said first lateral wing and said second lateral wing;

said backstop, said first lateral wing and said second lateral wing comprising a rigid, lightweight frame and netting attached to said frame by netting attachment means; the length of said first lateral wing being greater than the length of said backstop and the length of said second lateral wing being greater than the length of said backstop;

an extended tongue comprising a fixed end connected to said backstop and a free end, said tongue extending from said backstop in the direction opposite the direction in which the first and second lateral wings extend from said backstop; and wheels pivotally attached beneath said first lateral wing, said second lateral wing, and said extended tongue, where one of said wheels is attached adjacent said free end of said first lateral wing, another of said wheels is attached adjacent said free end of said second lateral wheel, another of said wheels is attached adjacent said attached end of said first lateral wing, another of said wheels is attached adjacent said attached end of said second lateral wing, and another of said wheels is attached adjacent said free end of said extended tongue, and dual wing attachment means adapted to connect one lateral wing of one device adjacent a lateral wing of a second device.

2. The device of claim 1, where said extended tongue comprises a first connector member and a second connector member, said first connector member joining said free end of said tongue to said first end of said backstop, and said second connector member joining said free end of said tongue to said second end of said backstop.

3. The device of claim 2, where said first connector member and said second connector member form an angle of approximately 100 degrees.

4. The device of claim 1, where said non-rigid top is comprised of netting means of sufficient width such that said first lateral wing and said second lateral wing can be positioned with interior angles greater than 90 degrees relative to said backstop.

5. The device of claim 4, where said top further comprises suspension means to retain said netting means generally horizontal relative to the ground.

6. The device of claim 4, where said device further comprises means to tighten said netting material of said top such that said netting means of said top is positioned generally horizontal relative to the ground.

7. The device of claim 1, where said netting attachment means comprise hook and loop type fasteners.

8. The device of claim 1, where said dual wing attachment means comprise mechanical type fasteners.

9. The device of claim 1, where said dual wing attachment means comprise hook and loop type fasteners.

* * * * *